US005367903A

United States Patent [19]

Keller

[11] Patent Number: 5,367,903

[45] Date of Patent: Nov. 29, 1994

[54] PROCESS FOR IMPROVING THE DRAWABILITY OF A METAL SHEET OR SHEET BLANK

[75] Inventor: Jacques Keller, Florange Cedex, France

[73] Assignee: Sollac, Puteaux, France

[21] Appl. No.: 838,252

[22] PCT Filed: Sep. 4, 1990

[86] PCT No.: PCT/FR90/00643

§ 371 Date: Mar. 11, 1992

§ 102(e) Date: Mar. 11, 1992

[87] PCT Pub. No.: WO91/03334

PCT Pub. Date: Mar. 21, 1991

[30] Foreign Application Priority Data

Sep. 11, 1989 [FR] France ..... 89 11948

[51] Int. Cl.[5] ..... B21B 45/02

[52] U.S. Cl. ..... 72/42; 252/49.3; 72/46

[58] Field of Search ..... 252/49.3, 49.5; 72/42, 72/46

[56] References Cited

U.S. PATENT DOCUMENTS

| | | | |
|---|---|---|---|
| 2,343,036 | 2/1944 | Wilson | 72/42 |
| 2,831,782 | 4/1958 | Zvanut | 72/42 |
| 2,990,610 | 7/1961 | Luckerath et al. | 72/42 |
| 3,125,519 | 3/1964 | Grave et al. | 72/42 |
| 3,390,562 | 7/1968 | Rausch | 72/42 |
| 3,577,753 | 5/1971 | Shah | 72/41 |
| 4,381,064 | 4/1983 | Das . | |

FOREIGN PATENT DOCUMENTS

| | | |
|---|---|---|
| 1509033 | 1/1968 | France . |
| 2282302 | 3/1976 | France . |
| 2286208 | 4/1976 | France . |
| 2629103A1 | 9/1989 | France . |
| 197926 | 9/1938 | Switzerland . |
| 1519057 | 7/1978 | United Kingdom . |
| 1552238 | 9/1979 | United Kingdom . |
| 8202058 | 6/1982 | WIPO . |

OTHER PUBLICATIONS

Chemical Abstracts, vol. 93, No. 2, Jul. 1980, (Columbus, Ohio, US), p. 149, abrege No. 10611j, & DD, A, 1391349J, Neukirchner), 12 Dec. 1979.

Sheet Metal Industries, vol. 61, No. 1, Jan. 1984, (London, GB), "Dry film lubrication for forming", see p. 38.

*Primary Examiner*—Daniel C. Crane

*Attorney, Agent, or Firm*—Oblon, Spivak, McClelland, Maier & Neustadt

[57] ABSTRACT

The process is characterized by the fact that, before drawing, a salt of the alkaline metal group formed by Li, Na, and K, and of an anion which is chemically inert with regard to the essential metal of the sheet chose from among the phosphates is deposited on the drawing tools. To deposit the salt, preferably, a solution of said salt is applied to the tools or to the sheet metal.

17 Claims, 1 Drawing Sheet

FRICTION COEFF.

WITHOUT TREATMENT
WITH TREATMENT
.2
.15
.1
.05
0
100
200
300
400
500
600
700
800
PRESSURE (BARS)

P
BARS
150
100
50
0
10
20
30
Q
mg/m²

PROCESS FOR IMPROVING THE DRAWABILITY OF A METAL SHEET OR SHEET BLANK

FIELD OF THE INVENTION

The present invention relates to a process for improving the drawability of metal, especially steel, sheets or sheet blanks, and to the use of this process either during the drawing or beforehand by treating the sheet intended to be drawn. It also relates to the sheet which is thus treated.

BACKGROUND OF THE INVENTION

The well-known principle of drawing consists in deforming plastically a sheet blank held at its periphery between a cavity and a blank-clamp by means of a punch, the cavity and the punch having a configuration determined as a function of the desired shape of the drawn product.

The punch, the cavity and the blank-clamp, which are the members brought into contact with the blank during the drawing operation, will be called, as a group, drawing tools in what follows.

In processes for shaping by plastic deformation, such as drawing, the sheet-tool friction coefficient plays an important part. It can limit the ability of the sheet to deform and can result in ruptures of the blank if it is too high.

The lubrication, the state of the surface and the nature of the tools are parameters which can be modified to reduce the friction.

During drawing, the surface of these tools which is in contact with the blank is lubricated, generally with a liquid lubricant or a drawing oil, to facilitate the deformation of the blank, to reduce the friction coefficient between blank and tools and thus to limit the risks of seizure and of rupture of the blank.

However, this lubrication is not always sufficient to prevent the seizure and the rupture of the sheet blank, especially when the drawing pressure is high.

To solve these problems it has already been proposed to carry out a treatment of the surface of the sheet to be drawn. In particular, there are known processes for chemical conversion of the surface of the sheet, such as phosphating, which make it possible to lower the sheet-tool friction coefficient and thus promote the shaping of the blank. However, such a treatment is costly and cannot be applied to all the sheets intended to be drawn.

A drawing process is also known from document U.S. Pat. No. 3,390,562, according to which a lubricating composition consisting of an oil and of salts is employed. However, this composition cannot be homogeneous. As a result of this, the lubricating capacity of such a product is not uniform at all points of the sheet, because the salt is not distributed uniformly at its surface, and this interferes with the drawing operation.

A disadvantage of these processes also lies in the fact that they result in a modification of the chemical characteristics of a layer of metal at the surface of the sheet. Although it may be tiny, this layer, which remains at the surface after the component has been shaped, can be found to interfere with the use of the component obtained. In particular, incompatibility may exist between the surface characteristics obtained and the desired chemical treatments after shaping. Other disadvantages relating to the use of the components after shaping may also be prohibitive. For example, phosphating of the sheets constitutes a considerable impediment when the components which have been subjected to it are welded.

Another disadvantage of these processes lies in the weight and the cost of the industrial plant needed for these surface treatments. A plant for phosphating sheets is costly, both owing to the size of the hardware of which it consists and to its high energy requirements. In addition, the chemical conversion processes involve a minimum period of treatment and therefore, in the case of a treatment in a continuous production line, a considerable length and bulkiness of the treatment plant.

Other attempts have been made, furthermore, to improve the lubricating characteristics of drawing oils. However, the risk of seizure remains, especially in regions subject to high pressures, such as the tool edges, where the lubrication with such oils may be found insufficient.

SUMMARY OF THE INVENTION

The objective of the present invention is to solve these various problems and to do away with the above-mentioned disadvantages.

With these objectives in mind, the subject of the invention is a process for improving the drawability of metal, especially bare or coated steel, sheets or sheet blanks, characterised in that, before cold drawing, there is deposited on the sheet, or only on the drawing tool, a salt of an alkali metal chosen from the group consisting of Li, Na and K and of an anion which is chemically inert towards the metal of which the sheet consists, chosen from phosphates, the deposition of the said salt being carried out by application to the said tools or the said sheet of a solution of the said salt, an oil being excluded.

According to a first application, the process is used during the drawing of metal sheet blanks by means of drawing tools comprising a cavity, a blank-clamp and a punch, and the deposition is carried out by applying a solution of said salt to the tools.

According to an alternative form of the invention, the application of the said solution is made to tools degreased beforehand. Drying of the tools may then be carried out. The tools may then be either oiled with a drawing lubricant, before the drawing of the blank is undertaken, or the preoiled sheet blank may be drawn directly.

According to another alternative form, the application of the salt or of the solution is carried out on preoiled tools.

The application of the solution may be preferably carried out by depositing drops of the said solution, which are distributed over the tools or localised in certain regions of the latter which are particularly subject to seizing, such as the areas facing the cavity and the blank-clamp or the most angular regions of the tools.

By virtue of the invention, the risks of seizure and of rupture of the blank can be considerably reduced or even eliminated. Moreover, the pressure of the blank-clamp can be raised without increasing this risk, and this improves the confinement of the edges of the blank between the cavity and the blank-clamp and prevents the formation of folds or undulations at these edges. Furthermore, in the case where a seizure were nevertheless to occur during the drawing operation, the application of the said salt prevents the adhesion of scuffings to the tools, that is to say of traces of the constituent metal of the sheet which is drawn and torn away therefrom during the eventual seizure. As a result, the component drawn during the following operation does not run the risk of being damaged by scuffings adhering to the tools.

An explanation which the inventors put forward for the observed improvement in drawing is that the salt deposited on the tool forms a saponifying agent which, by reacting with the drawing oil, forms a soap, this reaction taking place especially by virtue of the pressure and temperature conditions created at the surfaces of tool-blank contact during the drawing.

According to another application of the process, the salt deposition may be carried out on the sheet before drawing, or even during its manufacture.

Another subject of the invention is therefore also a metal sheet characterised in that it comprises on at least one face a film of a saponifying product causing the formation of a soap by reaction with an oil, this oil being of the type commonly employed during the drawing operations. It will be noted that here and in the continuation of this specification the term "drawing" will be employed to denote generally any processes for shaping sheet metal by plastic deformation.

The said product is preferably a salt of an alkali metal chosen from the group consisting of Na, K and Li, deposited on the surface of the sheet in a proportion of more than 10 milligrams per $m^2$ of area, and less than 100 $mg/m^2$.

Also preferably, the said salt is a salt of an anion which is chemically inert towards the metal of which the sheet consists, chosen from phosphates.

Another subject of the invention is a process for producing the above sheet, this process being characterised in that the alkali metal salt is deposited by applying to the surface of the sheet an aqueous solution of the said salt and the sheet thus treated is then dried to evaporate the solvent.

This solution preferably contains from 10 to 100 g of the said salt per liter of water.

Also preferably, the solution contains potassium and phosphate ions and hydronium ions, and is neutralised.

The application of the solution to the sheet may be carried out especially by spraying, immersion or coating, the sheet being dried immediately after application of the solution.

The present invention, taken in one of its various embodiments set out above, makes it possible to reduce considerably the value of the sheet-tool friction coefficient during the drawing, this being so whether the sheets are bare or coated, for example galvanised, before the treatment.

When compared with the sheets referred to above, treated by chemical conversion of their surfaces, the sheets according to the invention are found to be very economical. Their process of manufacture allows an appreciable saving in space to be obtained with regard to the plant needed for its implementation.

Other characteristics and advantages will appear in the description which will be given by way of example, on the one hand of tests implementing a process in accordance with the invention in the case where the said salt is deposited onto the drawing tools and, on the other hand, of comparative tests of sheets treated according to the invention and then subjected to drawing.

BRIEF DESCRIPTION OF THE DRAWINGS

Reference will be made to the attached drawings, in which.

Figure 1:
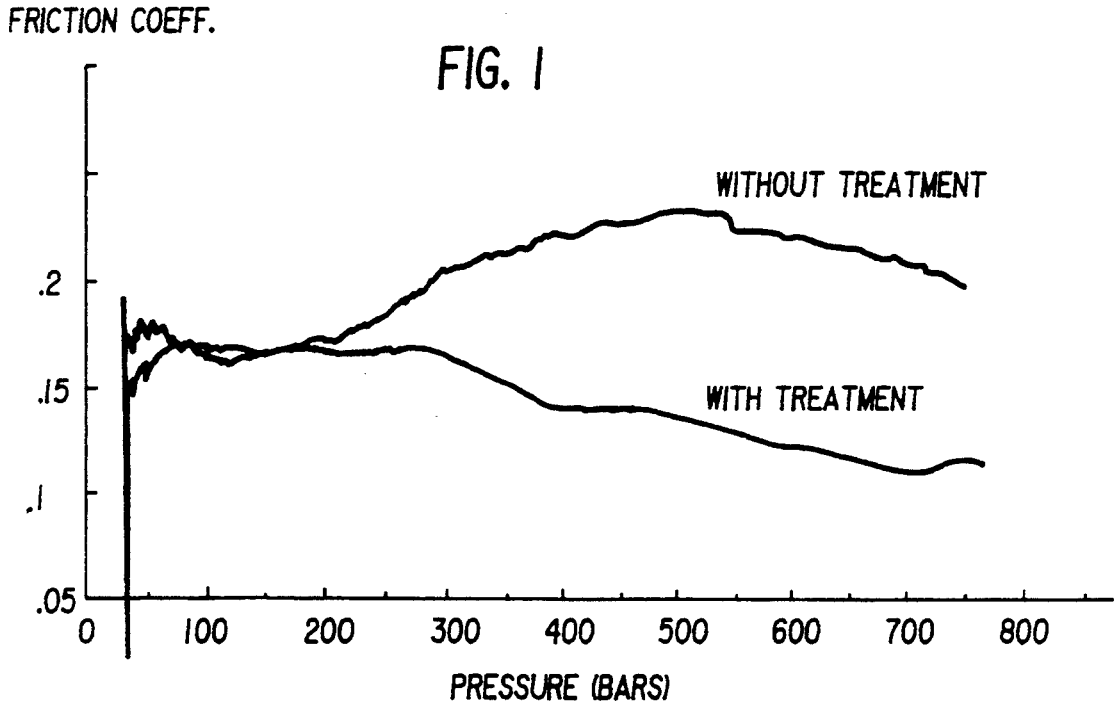
FIG. 1 is a graph showing two curves representing the friction coefficient as a function of pressure, these curves having been established under the same operating conditions for treated and untreated sheets respectively.

The tests carried out by depositing the salt on the drawing tools will be described first of all.

These tests were carried out with a conventional tool for drawing blanks of bare sheet and of sheet electrogalvanised on one face.

The deposition of salt on the tools was carried out by applying a solution of $K_3PO_4.2H_2O$ diluted in water to concentrations of 5 to 20 grams per liter.

A number of tests were carried out, consisting in drawing a number of blanks with the same tool under different operating conditions, the ratio of the diameter of the blank to the diameter of the punch being 2.1 in all cases.

In each test the blank-clamp force needed to obtain rupture of the blank was investigated.

The following tests were carried out in the case of each sheet grade, bare or coated on one face:

- drawing according to the traditional process, without application of the $K_3PO_4$ solution,
- drawing according to the invention, with application of the $K_3PO_4$ solution to the punch, the cavity and the blank-clamp, which were cleaned and degreased beforehand, and by two methods, one consisting in drawing the blank without preliminary drying of the tool after the application and therefore allowing an excess of water to remain on the tools, and the other consisting in drawing the blank after drying the tool,
- drawing according to the invention, with application of the solution to preoiled tools.

The results of these tests are shown in the table below, where the blank-clamp force needed to obtain rupture of the blank has been shown for each of the abovementioned tests:

| | | $K_3PO_4.2H_2O$ on clean and degreased tool | | | |
|---|---|---|---|---|---|
| Grades | Traditional conditions | with excess water | after drying | $K_3PO_4.2H_2O$ on oiled tool | Gain in % |
| Bare sheet | 180 kN | 240 kN | 240 kN | 240 kN | 33 |
| Sheet coated on 1 face Cavity-side coating | 120 kN | 180 kN | 180 kN | 180 kN | 50 |

Other tests were also carried out to determine the quantity of salt to be deposited on the tools and needed to obtain a marked improvement in drawability when compared with traditional processes.

It can be seen that, by virtue of the process according to the invention, the blank-clamp force before blank rupture is increased by 33% in the case of the drawing of a bare sheet blank, and by 50% in the case of coated sheet.

The process according to the invention makes it possible to increase the blank-clamp force considerably before rupture, and therefore the control width of the drawing press. Thus, by virtue of the process according to the invention, the blank-clamp force can be increased without increasing the risk of seizure and rupture and it is therefore possible, for example, to produce in a single pass drawn components which are deeper than in the drawing processes according to the prior art, or to reduce the formation of folds or undulations in these components.

The results of these tests are listed in the table below, which shows, for each sheet grade and in the two cases of drawing according to the invention, with application of salt to tools degreased beforehand, the concentration of potassium in milligrams per $m^2$ of the tool area. In these tests a constant quantity of solution was deposited on the tools, the potassium concentration of this solution being varied.

| | Potassium concentration in $mg/m^2$ on the tool | |
|---|---|---|
| Grades | With excess water | After drying/ evaporation of surplus water |
| Bare sheet | 350 | 200 |
| Coated sheet | 150 | 100 |

It can thus be concluded that in the case of drying after application of the solution to the tools, and therefore evaporation of the excess water, the quantity of $K_3PO_4.H_2O$ which is needed is markedly decreased when compared with the case where the drawing is carried out without the tools being dried beforehand.

Furthermore, during these tests the inventors found that the use of a solution of relatively low potassium concentration and therefore, for an equal quantity of deposited salt, a larger quantity of solution and therefore of water which is employed, delays the action of the salt and produces a suction-cup effect between the cavity and blank-clamp which interferes during the drawing.

It is therefore preferable to perform an at least partial drying of the tools after the solution has been applied, both to reduce the quantity of salt which is needed and to improve the drawing, this drying being preferably carried out using pulsating hot air.

The inventors also found that the improvement in drawability due to the use of the process according to the invention is practically immediate during the drawing of coated sheet, whereas with bare sheet blanks this improvement appears only after drawing a number of blanks, carried out with a reduced blank-clamp pressure.

Still further tests have made it possible to determine the durability of the effect of the salt application to the tool. To do this, a preliminary application of the solution was carried out and then a number of blanks were drawn in succession without renewing the application, the drawing being then carried out with a blank-clamp force corresponding to approximately a half of the possible gain as determined by the first series of tests (that is approximately 210 kN in the case of the bare sheet). From 5 to 6 bare sheet blanks and from 10 to 12 coated sheet blanks could thus be drawn without rupture.

As a result of these tests it has been found preferable, in the course of a campaign of drawing according to the process of the invention, to employ a solution of high concentration in order to start up more rapidly the process resulting in the improvement of drawability and, especially in the case of bare sheet drawing, to reduce the blank-clamp pressure in relation to the pressure sought after during this campaign, on the first two or three blanks drawn after the initial application of the solution.

Of course, in the case of the application of the solution to tools degreased beforehand, this application does not eliminate the need for lubrication, it being possible for the latter to be carried out either by lubricating the tool after the solution has been applied or by using preoiled sheet blanks.

Tests carried out by applying salt to the sheet, followed by drawing blanks of the sheet thus treated will now be described.

The process according to the invention was tried out on bare sheets and on coated (galvanised) sheets. The inventors observed a more appreciable improvement in the drawing characteristics in the case of coated sheets.

The experiments conducted by the inventors in the laboratory and on industrial plant showed that untreated sheets stressed in drawing break at a low blank-clamp pressure (40 bars) whereas these same sheets treated according to the invention allow blank-clamp pressures of 140 bars to be attained before rupture.

This results not only in the possibility of carrying out drawing at high pressure, but also in a considerable increase in the scope for drawing, that is to say the blank-clamp pressure range, which is limited at low pressures by the appearance of folds in the drawn shape and at high pressures by tearing of the blank.

The table below illustrates the results obtained during drawing tests on samples obtained by five samplings. One half of the samples (A) from samplings 1, 2 and 3 having been treated in the laboratory, and the samples (B) from the samplings 4 and 5 treated on industrial production lines.

Each sample is a steel sheet blank on which sodium phosphate is deposited by coating the surface of the sheet with an aqueous solution containing 60 g of sodium phosphate per liter, so that the quantity of sodium phosphate is 20 $mg/m^2$, and then drying the sheet and, finally, coating it with an ordinary protective oil.

| | Blank-clamp pressure at which breakage occurs (bars) | | |
|---|---|---|---|
| Reference | Without treatment | | After treatment |
| 1 | 40 | A- | >100 |
| 1 | 40 | | >140 |
| 1 | 40 | | >140 |
| 2 | 40 | | 120 |
| 3 | 40 | | 120 |
| 4 | 60 | B- | 160 |
| 4 | 60 | | 160 |
| 4 | 60 | | 180 |
| 5 | 40 | | 140 |
| 5 | 40 | | 140 |
| 5 | 40 | | 160 |

Other tests have made it possible to obtain the curves in the graph of FIG. 1, showing the variation in the friction coefficient as a function of pressure. These curves were obtained by measurement on a conventional tribometer with parallel surfaces, with sheets electro-galvanised on both faces, the coating of which has a thickness of 10 μm.

It is easily concluded that, in the case of the treated sheet, the friction coefficient is overall markedly lower than in the case of the untreated sheet.

Figure 2:
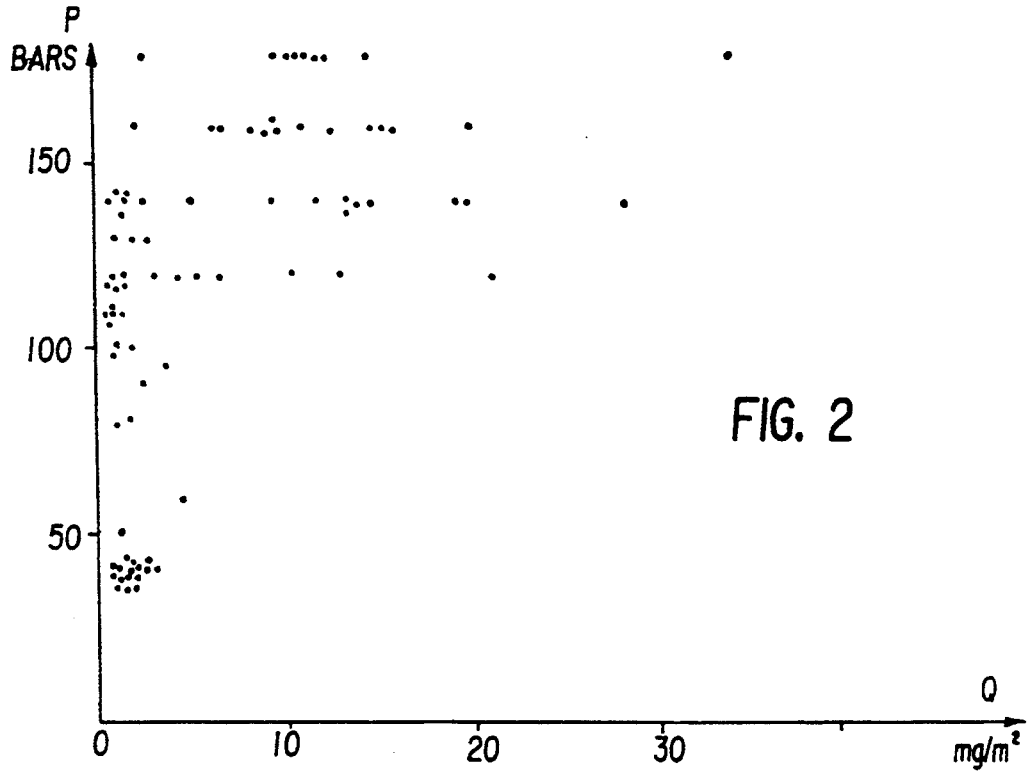
FIG. 2 is a graph showing, for different tests, the variation in blank-clamp pressure P causing the rupture of the blank, as a function of the quantity Q of salt deposited on the sheet, expressed in mg of potassium per $m^2$.

The graph in FIG. 2 shows the result of other tests carried out while varying the quantity Q of salt, potassium phosphate of formula $K_3PO_4$ in this case, deposited on the sheet (on one face only), expressed in mg of potassium per $m^2$.

It is found that, in the case of quantities of less than approximately 5 $mg/m^2$, the blank-clamp pressure values P resulting in rupture of the blank are scattered, in many cases with rupture in the case of pressures close to 40 bars, whereas in the case of quantities of more than 5 $mg/m^2$ no rupture is observed up to 120 bars.

It should be remembered that, in the case where the salt deposition is carried out on the sheet or on the blank, this treatment obviously does not do away with the necessity of oiling the sheets before drawing, since the improvement in drawability obtained by virtue of the invention results from the combination of the products deposited in accordance with the invention and of the oil commonly employed during the drawing operation.

I claim:

1. A process for improving the cold drawability of metal consisting essentially of, before cold drawing, depositing on a drawing tool a salt consisting essentially of an alkali metal chosen from the group consisting of Li, Na, and K and an anion which is chemically inert towards the metal of which the sheet consists, chosen from phosphates, wherein said deposition step of said salt is carried out by application, to said tool, of a solution of said salt, wherein said solution does not comprise oil.

2. A process according to claim 1, wherein said application of the solution is to certain regions of said tool.

3. A process according to one of claims 1 or 2, wherein said deposition step is carried out on a tool which has been previously degreased.

4. A process according to claim 3, wherein said tool is at least partially dried after said solution has been applied.

5. A process according to claim 3, wherein said tool is oiled after application of the solution.

6. A process according to claim 3, further comprising drawing of a preoiled sheet blank.

7. A process according to one of claims 1 or 2, wherein said solution is applied to an oiled tool.

8. A process according to claim 1, wherein said application step is carried out by depositing drops of said solution distributed over said tool.

9. A process according to claim 1, further comprising drawing more than one blank after application of the solution, prior to reapplying said solution.

10. A process as claimed in claim 1 wherein said metal is selected from bare or coated steel, sheets, and sheet blanks.

11. A process as claimed in claim 1, wherein said solution consists of water and 5–20 g/l of $K_3PO_4.2H_2O$.

12. A method to improve the cold drawability of metallic sheets or sheet blanks, consisting essentially of applying to the surface of said sheets or sheet blanks, and aqueous solution consisting essentially of an alkali metal salt chosen from the group consisting of Li, Na and K and of an anion which is chemically inert towards the metal of which the sheet is formed, wherein said anion is a phosphate, wherein said aqueous solution does not contain oil, and wherein after said solution has been applied said solution is dried.

13. The method of claim 12, wherein said solution further comprises hydronium ions.

14. A method according to claim 12, wherein said aqueous solution comprises potassium phosphate, and 5–20 g/l of $K_3PO_4.2H_2O$.

15. A method according to claim 12, wherein said solution comprises potassium phosphate $K_3PO_4$, and wherein after said solution has been applied, said solution is dried, wherein after drying the amount of salt uniformly deposited is greater than 5 $mg/m^2$ of potassium.

16. A method as claimed in claim 12 wherein said metallic sheets or sheet blanks are made of bare or coated steel.

17. A method as claimed in claim 12, wherein said aqueous solution consists of water and 5–20 g/l of $K_3PO_4.2H_2O$.

* * * * *